US009648906B2

(12) United States Patent
Fabregas Pedrell

(10) Patent No.: US 9,648,906 B2
(45) Date of Patent: May 16, 2017

(54) CIGARETTE DISPENSING DEVICE

(71) Applicant: CIT, S.A., Barcelona (ES)

(72) Inventor: Jose Maria Fabregas Pedrell, Barcelona (ES)

(73) Assignee: CIT, S.A., Barcelona (ES)

( * ) Notice: Subject to any disclaimer, the term of this patent is extended or adjusted under 35 U.S.C. 154(b) by 0 days.

(21) Appl. No.: 14/387,074

(22) PCT Filed: Nov. 28, 2013

(86) PCT No.: PCT/ES2013/000265
§ 371 (c)(1),
(2) Date: Sep. 22, 2014

(87) PCT Pub. No.: WO2014/060616
PCT Pub. Date: Apr. 24, 2014

(65) Prior Publication Data

US 2015/0272212 A1 Oct. 1, 2015

(30) Foreign Application Priority Data

Dec. 20, 2012 (ES) ..... 201231974

(51) Int. Cl.
*A24F 15/00* (2006.01)

(52) U.S. Cl.
CPC ..... *A24F 15/005* (2013.01)

(58) Field of Classification Search
CPC combination set(s) only.
See application file for complete search history.

(56) References Cited

U.S. PATENT DOCUMENTS 4,615,681 A * 10/1986 Schwarz ..... A24F 15/005 131/270
5,203,472 A 4/1993 Levenbaum et al.
5,566,855 A 10/1996 Bradach
(Continued)

FOREIGN PATENT DOCUMENTS

ES 1055235 U 11/2003
ES 2299320 A1 5/2008
(Continued)

OTHER PUBLICATIONS

International Search Report for corresponding International Application No. PCT/ES2013/000265.

*Primary Examiner* — Timothy Waggoner
*Assistant Examiner* — Stephen Akridge
(74) *Attorney, Agent, or Firm* — Egbert Law Offices, PLLC

(57) ABSTRACT

A cigarette dispensing device includes a case provided with a lid including a closure element controlled by an electric actuator, an electronic plate, and a rechargeable battery for powering the electronic plate and the electric actuator. The opening of the case is actuated using an application installed on a mobile terminal. The application is designed to: receive a request for the remote opening of the case from the user; establish a variable delay time between the case opening request from the user and the transmission of an opening command to the case via a wireless communication; and, during the variable delay time, transmit an information message to the screen of the mobile terminal.

3 Claims, 4 Drawing Sheets

(56) References Cited

U.S. PATENT DOCUMENTS 6,125,082 A * 9/2000 Reid ..... A24F 15/005 131/270
8,307,834 B1 * 11/2012 Palmerino, Sr. ..... A24F 15/005 131/270
2001/0027794 A1 * 10/2001 Brue ..... A24F 47/00 131/270
2004/0031498 A1 * 2/2004 Brue ..... A24F 15/005 131/270
2004/0134247 A1 * 7/2004 Ernst ..... A47F 3/002 70/257
2004/0219904 A1 * 11/2004 De Petris ..... G06F 21/313 455/410
2007/0131704 A1 * 6/2007 Ahedo ..... A24F 15/005 5/5
2008/0029109 A1 * 2/2008 Hercules ..... A24F 47/00 131/270
2009/0077675 A1 * 3/2009 Cabouli ..... A45C 1/06 726/34
2010/0318218 A1 * 12/2010 Muncy, Jr. ..... G06F 19/3462 700/220
2011/0104648 A1 * 5/2011 Singer ..... G09B 19/00 434/236
2011/0112717 A1 * 5/2011 Resner ..... G07C 5/008 701/31.4
2011/0245633 A1 * 10/2011 Goldberg ..... A61B 5/681 600/301
2012/0253489 A1 * 10/2012 Dugan ..... A63F 13/10 700/91
2012/0256741 A1 * 10/2012 Ophardt ..... B05B 11/308 340/539.11
2015/0101940 A1 * 4/2015 Ash ..... H04M 1/21 206/216
2015/0181945 A1 * 7/2015 Tremblay ..... A24F 47/008 131/328

FOREIGN PATENT DOCUMENTS

JP 2002051761 A 2/2002
WO 2012129705 A1 4/2012

* cited by examiner

CIGARETTE DISPENSING DEVICE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

This invention refers to a cigarette dispensing device, designed for smokers who want to control or give up their smoking habit; the device comprises a cigarette case provided with a body which defines a receptacle for arrangement of the cigarettes to be dispensed, a lid including a closure element controlled by an electric actuator, an electronic plate, wireless connection means and a rechargeable battery for powering the electronic plate and the actuator.

This invention has its application in the manufacture of cigarette dispensing devices, used principally as an aid for therapies for controlling or eliminating the smoking habit.

2. Description of Related Art Including Information Disclosed Under 37 CFR 1.97 and 37 CFR 1.98.

Different devices and cigarette cases are currently known for the supply of cigarettes, the purpose of which is to provide the user with assistance in regulating or giving up the smoking habit.

Specifically, document ES 2299320 describes a device for supplying cigarettes which comprises: a compartment in which the cigarettes are stored, an opening through which the cigarettes are delivered and a collapsible lid which covers the aforementioned opening. The device also comprises activation means which include an actuator which, when activated, causes the lid to open, and a number of elements which move in conjunction with said actuator to supply a cigarette.

The aforementioned document also considers the possibility of the device including a screen which shows different options available to the user and a control panel which said user can use to access the different options appearing on the screen; this allows the user to program a certain time for a cigarette to be supplied once a certain time has elapsed since the previous supply.

Consequently, the cigarette supply device in the aforementioned document ES 2299320 only allows regulation of the time which elapses between the successive openings of the cigarette case, a time which can be adjusted by the user. This feature means that the device in question is not a suitable help for compulsive smokers, who can reduce to a minimum the time between successive openings; nor is it a help for smokers who do not have a great tobacco dependency, given that the cigarette case will open automatically once the time pre-established by the timer has elapsed, regardless of whether the user wants to smoke or not.

If a screen is included for the presentation of menus with different options or information, the cost of manufacture is increased notably, as is the final price which the user has to pay to acquire the device.

The document ES 2299320 A1 refers to a number of previous cigarette cases or devices to supply cigarettes, such as documents U.S. Pat. No. 5,566,855, U.S. Pat. No. 5,203,472 or JP 2002051761 which, in a more or less generalised fashion, have a compartment for cigarettes with a lid which opens and closes, and electronic means for opening the lid and dispensing cigarettes.

BRIEF SUMMARY OF THE INVENTION

The cigarette dispensing device which is the object of this invention is designed principally for smokers who want to regulate or give up their smoking habit, in which said device comprises a cigarette case with a body which defines an interior receptacle for the arrangement of the cigarettes to be dispensed, a lid with a closure controlled by an electric actuator, an electronic plate, wireless connection means and a rechargeable battery for powering the electronic plate and the actuator.

This cigarette dispensing device has certain construction features designed to open the aforementioned cigarette case using an application installed in a mobile handset, which is carried by the user, with the particular feature that said application transmits wirelessly an order to the electric actuator to open the cigarette case every time the user requests that a cigarette be dispensed, regardless of the time which has elapsed since the previous cigarette was dispensed, but establishing a variable delay time between the user's request to open the cigarette case and the transmission of the order to said cigarette case.

This allows the user to use the application installed in a mobile handset to request opening of the cigarette case to extract a cigarette every time he/she wants to smoke, but he/she will not have immediate access to said cigarette, but rather will have to wait until the variable delay time, established by the application, between the request to open the cigarette case and the transmission of said order to the cigarette case, has elapsed; the application will allow it to be opened during a certain period, after which, if it is not activated, the process of request and authorisation will have to be repeated.

This feature is of particular importance in controlling the smoking habit, as a majority of cigarettes are extracted from the packet and lit by the user in a totally mechanical way, with no rational analysis of the desire or real need to smoke at that moment.

Consequently, the introduction of a delay time between the user's request to open the cigarette case and the physical opening thereof prevents the user from extracting and lighting a cigarette compulsively.

Another of the objectives of the invention is to emit, during the variable delay time which elapses between the user's request to open the cigarette case and effective opening thereof, an information message on the screen of the mobile handset; this allows the user to rationalise and analyse the need and appropriateness of smoking the cigarette to which he/she will have access once the delay time set by the application has elapsed.

The characteristics of the cigarette dispensing device included in the first claim consider the opening of the cigarette case to be carried out through an application installed in a mobile handset carried by the user, and which may be, for example, a "smartphone" type mobile handset, which allows a reduction in the manufacturing costs of the cigarette case in itself and the use of the means contained in the mobile phone to run the application through which the user will make the request to open the cigarette case and the latter is then opened, after a delay time.

According to the invention, said mobile handset comprises: a microprocessor with memory, a screen suitable for presenting a variety of menus and information, a battery to power it and wireless means of communication suitable for establishing a communication with, at least, wireless means of communication associated with the electronic plate in the cigarette case and controlling remotely the activation of the electric actuator and the opening of the cigarette case.

This application is set up to: receive a remote request from the user to open the cigarette case; establish a variable delay time between the user's request to open the cigarette case and transmission to the cigarette case, via wireless communication, of an order to open; and emit during the variable delay time an information message on the screen of the mobile handset.

According to the invention, the application is associated with a database to record a variety of information, such as the times at which the cigarette case was opened, position coordinates corresponding to locations in which the user cannot smoke at any time, or at certain times, and other information provided by the user at the application's request, for example, the degree of satisfaction obtained after smoking each cigarette.

This information can be used subsequently to create a variety of statistics and vary the specific therapy for each user.

According to the invention, at the moment when the user makes a request to open the cigarette case, the application uses geo-positioning means in the mobile handset to determine position coordinates for the user and make a comparison with coordinates recorded previously in the database associated with the application, together with times and added information; the application then processes said information and cancels or delays the remote order to open the cigarette case when said coordinates coincide.

This feature allows the user's routine and tobacco consumption habits to be broken, preventing him/her from smoking in certain places, for example in his/her home or workplace, at any time, or at specific times, for example after lunch or dinner.

In summary, this device allows: a delay in the opening of the cigarette case once the user has requested that it be opened, thus eliminating the possibility of smoking immediately; the emission of messages on the mobile handset screen from the moment the request to open the cigarette case is made until it is actually opened; a change in the user's smoking habits, preventing him/her from smoking at usual times and/or in usual places; and for the application to vary, in successive phases and depending on the information provided by the user, the operating parameters of the device so that the user can reduce or even give up the smoking habit.

BRIEF DESCRIPTION OF THE SEVERAL VIEWS OF THE DRAWINGS

To complement the description being given and in order to facilitate understanding of the features of the invention, this description is accompanied with a set of drawings in which, for illustration purposes and in a non-restrictive manner, the following has been represented.

DETAILED DESCRIPTION OF THE INVENTION

Figure 1:
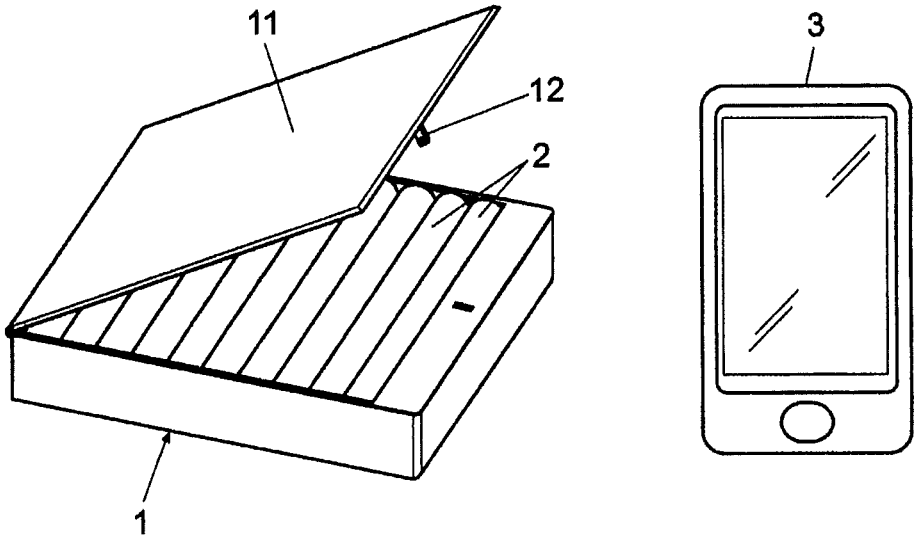
FIG. 1 shows a perspective view of an example embodiment of the cigarette dispensing device, with the cigarette case shown in the open position and the mobile handset containing the application used to activate the opening of said cigarette case.

In the example embodiment shown in FIG. 1, the elements forming the cigarette dispensing device can be seen, comprising a cigarette case (1) provided with a body which defines an interior receptacle in which the cigarettes (2) to be dispensed are arranged and a lid (11) with a closure (12) which is activated remotely using an application installed in a mobile handset (3).

Figure 2:
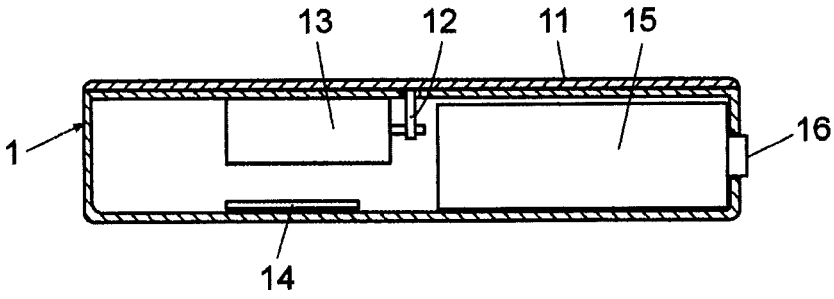
FIG. 2 shows a front elevation view of the cigarette case in the previous figure, with a cross-section through a vertical plane passing through the area in which the closure, the electronic plate and the rechargeable battery are located.
Figure 3:
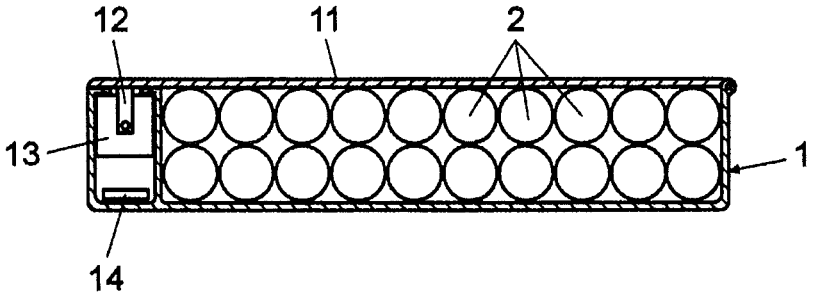
FIG. 3 shows a profile view of the cigarette case in FIG. 1 with a vertical cross-section.
Figure 4:
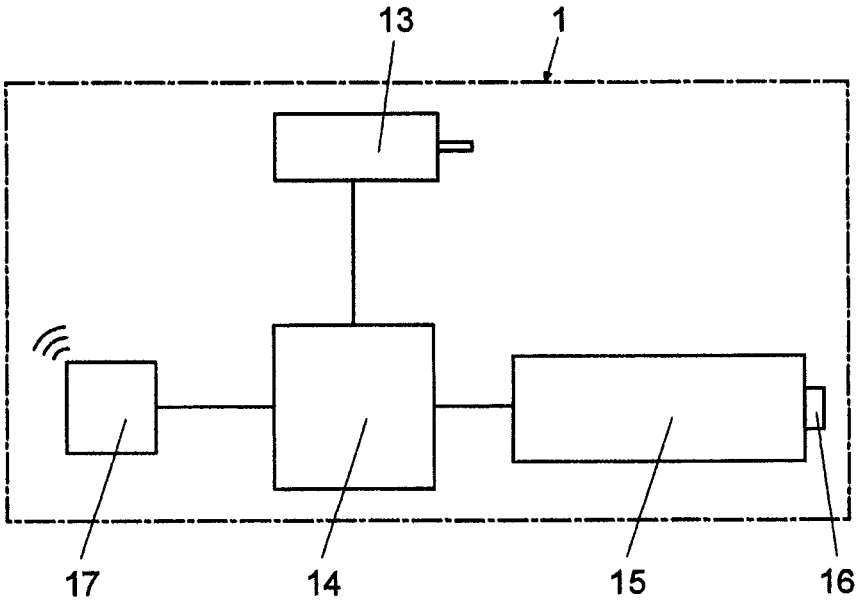
FIG. 4 shows an electrical diagram of the different elements integrated in the cigarette case.

As can be seen in FIGS. 2, 3 and 4, the closure (12) of the lid (11) is controlled by an electric actuator (13) connected to an electronic plate (14) in the cigarette case.

The cigarette case (1) includes, additionally, a rechargeable battery (15) and a USB connector (16) for external power and picking up information on the battery charge level.

The cigarette case (1) also includes means (17) of wireless communication, for example Bluetooth technology, for wireless receipt of an activation order for the electric actuator (13) and to open the lid (11) of the cigarette case.

The lid (11) of the cigarette case is opened by means of an application installed in the mobile handset (3) which in this case is represented by a smartphone, which has at least a processor with memory, a screen for the presentation of menus and a variety of information, a battery for power and wireless means of communication, for example Bluetooth, to establish a communication with the wireless means (17) of communication in the cigarette case.

It is worth mentioning that these mobile handset elements have not been represented in the attached figures because they are usual features of mobile phone handsets, like the one represented in FIG. 1.

Figure 5:
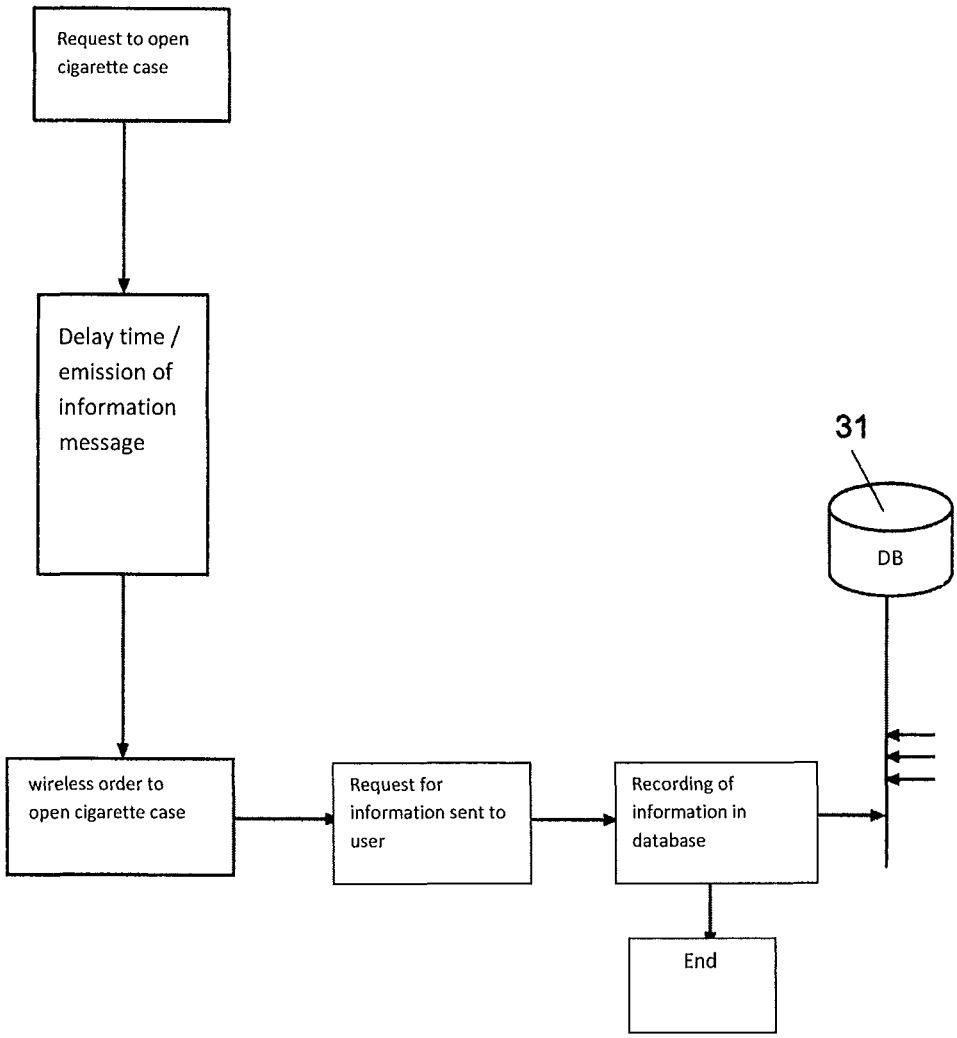
FIG. 5 shows a basic flow diagram of how the application loaded in the mobile handset used to open the cigarette case operates.

In the basic embodiment of the application, represented in FIG. 5, when the user sends a remote request to open the cigarette case (1) via the aforementioned application, the application establishes a variable delay time during which it emits an information message on the mobile handset screen (1), and subsequently transmits an order to open to the cigarette case (1) via a wireless communication.

When sufficient time has elapsed for the user to smoke the cigarette, the application sends a request for information to the user on a variety of parameters through the mobile handset (3) screen, and then records the information entered by the customer in a database (31) associated with the application, thus completing the operation.

Figure 6:
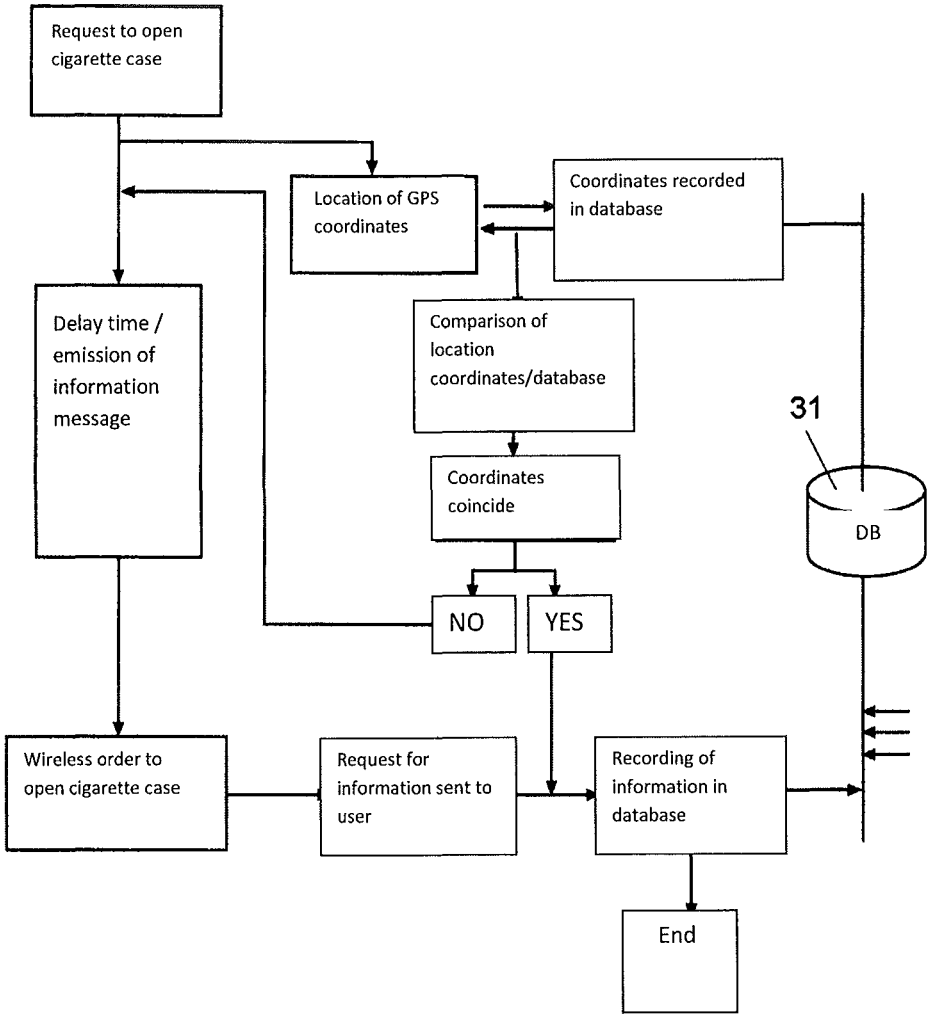
FIG. 6 shows a basic flow diagram of how the application loaded in the mobile handset used to open the cigarette case operates, including in this case a check of the user's location coordinates.

In the embodiment variation shown in FIG. 6, when the user sends a request to open the cigarette case via the application, the application uses geo-positioning features in the mobile handset (3) to determine the coordinates of the user's position and compares them with coordinates recorded previously in the database associated with the application, which correspond to locations in which the user cannot smoke, at least at certain times.

If the user's location coordinates coincide with those recorded in the database, the application records the information in the database and does not open the cigarette case.

If said coordinates do not coincide in the application, once the established delay time has elapsed and an information message has been emitted on the screen of the mobile handset, it sends a wireless order to open the cigarette case. Subsequently, and after sufficient time has passed for the user to smoke the cigarette, said application asks the user for information on certain aspects such as the satisfaction produced by smoking the cigarette or any others which can be recorded in the database to create subsequent statistics or determine the user's degree of dependency on tobacco and his/her consumption patterns, relating them to activities, times, company, places and the modification of the application's operating parameters, such as, for example, an increase or a reduction in the delay time.

Now that the nature of the invention has been described sufficiently, together with an example of preferred embodiment, it is stated for the relevant effects that the materials, form, size and arrangement of the elements described may be modified, provided this does not entail an alteration of the essential conditions of the invention which are claimed below.

The invention claimed is:

1. A cigarette dispensing system for regulating a smoking habit of a smoker, the cigarette dispensing system comprising:

a cigarette case having a body that defines an interior receptacle adapted to receive an arrangement of cigarettes therein;

a lid having a closure cooperative with said cigarette case, said closure controlled by an electric actuator and an electronic plate;

a rechargeable battery cooperative with said electronic plate and said electric actuator; and a mobile handset separate from said cigarette case and cooperative with said electric actuator and said electronic plate so as to control an opening of said lid of said cigarette case by said closure, said mobile handset having a microprocessor with a memory and screen and a battery, said screen adapted to present menus and a variety of information, said battery of said mobile handset supplying power to said microprocessor and to said screen, said mobile handset having a transmitter cooperative with said microprocessor so as to transmit a signal to said electronic plate so as to remotely activate said electric actuator for opening said lid of said cigarette case, said mobile handset having an application that receives a remote request from the smoker to open said lid of said cigarette case so as to allow the smoker to access the arrangement of cigarettes in said cigarette case, said microprocessor establishing a variable delay time between the remote request and the transmission of the signal and to present an information message on said screen during the variable delay time, said microprocessor having a memory with a database so as to record a variety of information, the variety of information selected from the group consisting of locations, times, activities, companies and a combination thereof.

2. The system of claim 1, said mobile handset having a geo-positioning sensor cooperative with said microprocessor so as to determine coordinates of a position of the smoker and to compare with coordinates previously recorded in the database so as to cancel or delay the remote request when the coordinates of the position coincides with the coordinates previously recorded.

3. The system of claim 1, the application enquiring the smoker as to a cigarette smoked, the microprocessor recording information as to the enquiry of the smoker as to cigarette smoked in the database.

* * * * *